United States Patent [19]

Redford et al.

[11] 4,006,778

[45] Feb. 8, 1977

[54] THERMAL RECOVERY OF HYDROCARBON FROM TAR SANDS

[75] Inventors: David A. Redford, Fort Saskatchewan; Stephen M. Creighton, Edmonton, both of Canada

[73] Assignee: Texaco Exploration Canada Ltd., Calgary, Canada

[22] Filed: June 21, 1974

[21] Appl. No.: 481,581

[52] U.S. Cl. ..... 166/261; 166/303

[51] Int. Cl.[2] ..... E21B 43/24

[58] Field of Search ..... 166/256, 259, 261, 272, 166/303

[56] References Cited

UNITED STATES PATENTS

| | | | |
|---|---|---|---|
| 2,839,141 | 6/1958 | Walter | 166/261 |
| 3,209,825 | 10/1965 | Alexander et al. | 166/261 |
| 3,292,702 | 12/1966 | Boberg | 166/303 |
| 3,375,870 | 4/1968 | Satter | 166/259 |
| 3,400,762 | 9/1968 | Peacock et al. | 166/259 |
| 3,409,077 | 11/1968 | Durie | 166/256 |
| 3,411,575 | 11/1968 | Connally | 166/259 |
| 3,411,578 | 11/1968 | Holmes | 166/256 |
| 3,500,913 | 3/1970 | Nordgren et al. | 166/259 |
| 3,605,890 | 9/1971 | Holm | 166/272 |
| 3,680,634 | 8/1972 | Peacock et al. | 166/261 |

*Primary Examiner*—Ernest R. Purser
*Assistant Examiner*—Jack E. Ebel
*Attorney, Agent, or Firm*—T. H. Whaley; C. G. Ries; Charles L. Bauer

[57] ABSTRACT

A method for the recovery of low API gravity viscous oils or bitumens from a subterranean formation by the injection of a mixture of an oxygen-containing gas and steam at a temperature corresponding to the temperature of saturated steam at the pressure of the formation.

8 Claims, No Drawings

THERMAL RECOVERY OF HYDROCARBON FROM TAR SANDS

BACKGROUND OF THE INVENTION

The present invention relates to an improved method for the recovery of oil from subterranean hydrocarbon-bearing formations containing low API gravity viscous oils or bitumens. More particularly, the invention relates to the production of bitumens and hydrocarbons from reservoirs of low mobility, such as tar sand formations.

The recovery of viscous oils from formations and bitumens from tar sands has generally been difficult. Although some improvement has been realized in stimulating recovery of heavy oils, i.e., oils having an API gravity in the range of 10° to 25° API, little, if any, success has been realized in recovering bitumens from tar sands. Bitumens can be regarded as highly viscous oils having a gravity in the range of about 5° to 10° API and contained in an essentially unconsolidated sand referred to as tar sands.

Vast quantities of tar sands are known to exist in the Athabasca region of Alberta, Canada. While these deposits are estimated to contain several hundred billion barrels of oil or bitumen, recovery therefrom using conventional in-situ techniques has not been too successful. The reasons for the lack of success relate principally to the fact that the bitumen is extremely viscous at the temperature of the formation, with consequent low mobility. In addition, these tar sand formations have very low permeability, despite the fact they are unconsolidated.

Since it is known that the viscosity of oil decreases markedly with an increase in temperature, thereby improving its mobility, thermal recovery techniques have been investigated for recovery of bitumens from tar sands. These thermal recovery methods generally include steam injection, hot water injection and in-situ combustion.

Typically, such thermal techniques employ an injection well and a production well traversing the oil-bearing or tar sand formation. In a steam operation employing two wells, steam is introduced into the formation through the injection well. Upon entering the formation, the heat transferred by the hot fluid functions to lower the viscosity of oil, thereby improving its mobility, while the flow of the hot fluid functions to drive the oil toward the production well from which it is produced.

Thermal techniques employing steam also utilize a single well technique, known as the "huff and puff" method. In the application of this method, steam is injected in quantities sufficient to heat up the subterranean hydrocarbonbearing formation in the vicinity of the well. Following a period of soak, during which time the well is shut-in, the well is placed on production.

In the conventional forward in-situ combustion operation, an oxygen-containing gas, such as air, is introduced into the formation via a well, and combustion of the in-place crude adjacent the wellbore is initiated by one of many known means, such as the use of a downhole gas-fired heater or downhole electric heater or chemical means. Thereafter, the injection of the oxygen-containing gas is continued so as to maintain a combustion front which is formed, and to drive the front through the formation toward the production well.

As the combustion front advances through the formation, a swept area consisting, ideally, of a clean sand matrix, is created behind the front. Ahead of the advancing front various contiguous zones are built up that also are displaced ahead of the combustion front. These zones may be envisoned as a distillation and cracking zone, a condensation and vaporization zone, an oil bank and a virgin or unaltered zone.

The temperature of the combustion front is generally in the range of 750°–1100° F. The heat generated in this zone is transferred to the distillation and cracking zone ahead of the combustion front where the crude undergoes distillation and cracking. In this zone a sharp thermal gradient exists wherein the temperature drops from the temperature of the combustion front to about 300°–450° F. As the front progresses and the temperature in the formation rises, the heavier molecular weight hydrocarbons of the oil become carbonized. These coke-like materials are deposited on the matrix and are the potential fuel to sustain the progressive in-situ combustion.

Ahead of the distillation and cracking zone is a condensation and vaporization zone. This zone is a thermal plateau and its temperature is in the range of from about 200° F. to about 450° F., depending upon the pressure and the distillation characteristics of the fluids therein. These fluids consist of water and steam and hydrocarbon components of the crude.

Ahead of the condensation and vaporization zone is an oil bank which forms as the in-situ combustion progresses and the formation crude is displaced toward the production well. This zone of high oil saturation contains not only reservoir fluids, but also condensate, cracked hydrocarbons and gaseous products of combustion which eventually reach the production well from which they are produced.

Various improvements relating to in-situ combustion are described in the prior art that relate to the injection of water, either simultaneously or intermittently with the oxygen-containing gas to scavenge the residual heat in the formation behind the combustion front, thereby increasing recovery of oil. Prior art also discloses regulating the amount of water injected so as to improve conformance or sweep.

Experience has generally shown that these conventional thermal techniques have not been altogether successful when applied to the recovery of heavy oils or bitumen. Where the hydrocarbons sought to be produced have a low API gravity, the build-up of the oil bank ahead of the thermal front occurs to a great extent. Since the heat transfer is low ahead of the front, these heavy hydrocarbons become cool and hence immobile, thereby causing plugging of the formation with the result that the injection of either air in the case of in-situ combustion, or steam in the case of steam, is no longer possible.

Furthermore, in the case of in-situ combustion, when applied to heavy oils, the high molecular weight fractions are carbonized which carbonaceous deposits serve as the fuel for the in-situ combustion reaction. Because the oil contains a high percentage of these fractions, very high fuel deposition occurs with consequent slow rate of movement of the combustion front. This results in high oxygen requirements per barrel of oil produced and lower oil recovery.

The difficulties recited above become compounded when these techniques are applied to the tar sands, because not only do the bitumens have a low API gravity, i.e., 6°–8° API and a higher viscosity, i.e., in the millions of centipoises, but also the permeability of the tar sands is so low that difficulty has been experienced in establishing fluid communication within the formation.

Accordingly, it is an object of the present invention to provide an improved recovery method whereby both highly viscous low gravity crudes and bitumens can be recovered more efficiently. The instant invention accomplishes this recovery of heavy oils and bitumens by means of a low temperature combustion or controlled oxidation that effectively permits a high rate of heat and fluid movement through the formation. Once this rate is established, the high rate of heat and fluid movement is maintained, thereby improving the transfer of heat to the formation and fluid movement leading to improved recovery.

SUMMARY OF THE INVENTION

This invention relates to an improved method of recovering low API gravity, viscous oils, and more particularly to the production of bitumens from tar sands by the injection of a mixture of an oxygen-containing gas and steam at a temperature corresponding to the temperature of saturated steam at the pressure of the formation.

DESCRIPTION OF THE PREFERRED EMBODIMENT

We have found that by simultaneously injecting an oxygen-containing gas and steam at a temperature corresponding to the temperature of saturated steam at the pressure of the formation, low temperature in-situ combustion of a portion of the bitumen can be effected at the temperature of the saturated steam. By saturated steam is meant steam having a quality of 100 percent. Quality of steam is defined as the percent by weight of dry steam contained in one pound of wet steam. Low temperature combustion or controlled oxidation is thus established and is controlled at a temperature much lower than the conventional in-situ combustion process or when steam is not injected simultaneously with the oxygen-containing gas.

The concept of the invention can be realized when the inventors' technique is contrasted with the conventional in-situ combustion process. In the conventional in-situ combustion process, as applied to heavy oils, because of the high percentage of heavy ends in a viscous oil or bitumen, the front advances at a slow rate and heavy coking occurs during its movement. This heavy coking results in much of the in-place hydrocarbons being carbonized, with the result that higher fuel consumption and lower oil recovery occurs. This high coking also may cause a decrease in the permeability of the formation to a point that may result in extinguishing the process. With the instant invention, coking is minimized as the combustion is advanced through the formation, since the oxidation process is controlled so that in-situ combustion is maintained without excessive carbonization of the hydrocarbons. With this type of oxidation reaction, blockage due to excessive carbonization does not occur. An added advantage is that with the visbreaking and mobility improvement ahead of the front, the degraded hydrocarbons are mobile and are transported into the virgin formation where they serve to dilute the in-place hydrocarbons and improve their mobility. The result is that blockage due to an excessive build-up of viscous oil ahead of the front is also reduced and additional recovery is realized.

The redistribution of the oxidative reactions and the increase in the advance of the front have been accomplished by lowering the temperature to control the combustion.

It is postulated that the oxidation that occurs by the simultaneous use of steam and an oxygen-containing gas may be explained in terms of oxidative molecular degradation that is not necessarily a combustion of all of the large asphaltic molecules such as are known to be present in tar sands. The mechanism may be explained in terms of cleavage of asphaltic clusters resulting in a hydrocarbon having a relatively low molecular weight, which has greater mobility. The molecular degradation may result from mild thermal cracking, termed visbreaking. The process might be considered as a controlled oxidation process in which the saturated steam partially quenches or reduces the burning rate near the injection point, which prevents the temperature from rising above the temperature of the saturated steam.

Indications are that some oxidizing reactions occur at low temperature, i.e. about 400° F. whereas other reactions do not, e.g., reaction of carbon and oxygen. By controlling the temperature in the formation, the reactions with carbon can be reduced or eliminated, leaving the oxygen unreacted to penetrate much farther into the formation before finding a reaction site, i.e., the activation energy is not high enough for carbon-oxygen reactions but is high enough for reaction of oxygen and some bitumen fractions.

In a broad aspect of the method of invention a hydrocarbon-bearing formation containing a heavy crude or a tar sand containing bitumen is first traversed by at least one injection well and one production well. An oxygen-containing gas, such as air, is injected until good transmissibility is achieved. It may be necessary to fracture the formation and/or inject a solvent to obtain adequate transmissibility. Thereafter, a mixture of the oxygen-containing gas and steam is injected, such mixture being injected preferably at a temperature in the range of 250° F. to 500° F., and corresponding to the temperature of the saturated steam at the pressure of the formation. Tests have shown that a temperature of about 420° F. is effective. By using steam at a temperature corresponding to the temperature of the saturated steam at the pressure of the formation, effective control of the temperature in the formation is maintained.

We have found that this procedure will initiate the low temperature in-situ combustion without having to use electric downhole heaters, or downhole gas burners or chemical ignition methods that are required for conventional high temperature combustion.

The oxygen-containing gas may be air, or a mixture of oxygen and non-condensible gases such as nitrogen, carbon dioxide or flue gas, or it may be substantially pure oxygen.

We have also found that it is not necessary to utilize 100% quality saturated steam. We have conducted tests using 60% quality steam and the recovery was comparable to tests using higher quality steam.

While the temperature of the mixture is preferred to be in the range of 250° to 500° F., this may be realized by repressuring the formation to a pressure corresponding to that temperature of saturated steam in the desired temperature range. For example, the formation may first be repressured to about 300 psi, so that the temperature of injected steam and oxygen-containing gas can be in the range of 420° F.

A substantial portion of the injected steam and oxygen-containing gas passes through the combustion zone, such that the oxygen in the gas is capable of reacting with the in-place hydrocarbons to achieve the described controlled oxidation. By continued injection of the mixture, the swept area behind the front is maintained in the range of 250° F. to 500° F., which permits the in-situ combustion to be sustained and displaced through the formation.

To illustrate this invention, a series of laboratory tests was performed using a tar sand from the McMurray formation in Alberta, Canada. Approximately 170–190 lbs. of tar sand was packed in a cell approximately 15 inches long and 18 inches in diameter. The cell was equipped for operating at controlled temperatures up to 420° F. and pressures of 300 psi, and contained simulated suitable injection and production wells. In addition, the cell contained many thermocouples, so that both temperatures throughout the cell could be measured, and heat transfer rates could be calculated. A communications path consisting of clean 20–40 mesh sand was placed between the simulated wells, and fluid communication was established prior to commencement of a test by the injection of nitrogen.

In a typical run the pressure of the cell was maintained at 300 psi during the test. An in-situ combustion was established by the simultaneous injection of air and steam at the saturation temperature of steam of about 417° F. and a pressure of about 300 psi. The accompanying table shows the results.

TABLE

| RUN | FLUIDS INJECTED | INJECTION PRESSURE (psi) | INJECTION TEMP (° F) | TIME (hr) | PRODUCTION RATE b (lb/hr) | RECOVERY % |
|---|---|---|---|---|---|---|
| 1 | Steam | 300 | 417 | 9 | 0.56 | 22* |
| 2 | Air & Steam | 300 | 417 | 26 | 0.99 | 43* |
| 3 | Oxygen & Steam | 300 | 417 | 13 | 2.09 | 63* |
| 4 | Air & Steam[a] | 300 | 417 | 27 | 0.73 | 43* |

*Normalized to termination at 96% water production.
[a]60% Steam Quality
[b]At 14% recovery The results show that when using either air-steam mixtures or oxygen-steam mixtures, production of bitumen was higher than when using steam alone. Furthermore, the production rate was higher. Gaseous products were also produced that contained about 20% $CO_2$ and 2 to 3% CO, indicating that in-situ combustion was occurring. The maximum temperature measured in the cell was that of saturated steam (417° F.) which is in contrast with high temperatures of 800°–1000° F realized in a conventional in-situ combination.

The results also showed that upon analysis of the contents of the cell after a run, the system still had some carbonaceous material present. Apparently, the rapid transport of heat away from the point of combustion initiation and the fact that residual combustible material remained throughout the system, resulted in not all of the oxygen being consumed in a narrow combustion zone as is the case with conventional in-situ combustion. Thus, without a narrow and well-defined combustion front the consumption of oxygen occurs in a much larger volume of the formation at a given time thereby permitting an increase in production rate and overall sweep of the formation.

Another unexpected result from these tests was that most of the production was bitumen containing water dispersions or occlusions, as distinguished from the results of using steam alone in which most of the produced bitumen was emulsified in steam condensate.

In summary, in accordance with this invention, recovery of heavy oils or bitumens is accomplished by the injection of a mixture of an oxygen-containing gas and steam at a temperature corresponding to the saturation temperature for the pressure of the formation, whereby low temperature combustion or controlled oxidation is established and maintained in-situ in a temperature range of 250°–500° F. in the formation to enhance the recovery of the oil or bitumen therein.

We claim:

1. A method for the recovery of hydrocarbons from subterranean hydrocarbon-bearing formations traversed by at least one injection well and at least one production well, and having fluid communication therebetween, comprising the steps of:

a. injecting via said injection well a mixture of steam having a quality of not more than 100 percent and an oxygen-containing gas, said mixture being injected at a temperature corresponding to the saturation temperature for saturated steam at the pressure of said formation, b. thereafter producing said hydrocarbons from said production well.

2. The method of claim 1 wherein the temperature of said saturated steam is in the range of about 250° F. to 500° F. and the quality of said steam is in the range of about 60 percent to 100 percent.

3. The method of claim 1 wherein said oxygen-containing gas is substantially pure oxygen.

4. The method of claim 1 wherein the oxygen-containing gas is air.

5. The method of claim 1 wherein the oxygen-containing gas comprises oxygen, nitrogen, carbon dioxide, flue gas and mixtures thereof.

6. The method of claim 1 wherein said formation is first repressured to a pressure corresponding to a temperature of saturated steam in the range of 250° F. to 500° F.

7. A method for the recovery of bitumens from tar sands traversed by at least one injection well and one production well, comprising:

a. injecting via said injection well a mixture of steam having a quality of less than 100 percent and a gas comprising principally pure oxygen, said mixture being at a temperature of the saturation temperature of steam corresponding to the pressure of said formation, thereby effecting a controlled oxidation of said bitumen in said formation, b. thereafter producing said bitumens from said production well.

8. The method of claim 7 wherein the temperature of said mixture is in the range of about 250° F. to 500° F.

* * * * *